US006904246B2

(12) United States Patent
Nami

(10) Patent No.: US 6,904,246 B2
(45) Date of Patent: Jun. 7, 2005

(54) IMAGE HEATING APPARATUS

(75) Inventor: Yasuo Nami, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 5 days.

(21) Appl. No.: 10/431,463

(22) Filed: May 8, 2003

(65) Prior Publication Data

US 2004/0009001 A1 Jan. 15, 2004

(30) Foreign Application Priority Data

May 10, 2002 (JP) ..... 2002-135984

(51) Int. Cl.[7] ..... G03G 15/20
(52) U.S. Cl. ..... 399/70; 399/69; 219/216
(58) Field of Search ..... 219/216; 399/37, 399/69, 70, 88, 328

(56) References Cited

U.S. PATENT DOCUMENTS 6,697,580 B2 * 2/2004 Nakayama ..... 399/33
2003/0111678 A1 6/2003 Colombo et al. ..... 257/240

FOREIGN PATENT DOCUMENTS

JP 2000-200013 7/2000

* cited by examiner

*Primary Examiner*—Hoang Ngo
(74) *Attorney, Agent, or Firm*—Fitzpatrick, Cella, Harper & Scinto

(57) ABSTRACT

An image heating apparatus is provided, which includes: a heating member for heating an image on a recording material; a temperature control unit for controlling a temperature of the heating member to a predetermined set temperature; a waiting state setting unit for setting a waiting state in which the temperature of the heating member is controlled to a first set temperature; and a waiting state releasing unit for releasing the waiting state in a shorter time between a set time from start of a waiting state releasing operation and a time needed to reach a second set temperature at which the waiting state is released. An image formable state can be recovered from a low power mode in a short time.

10 Claims, 3 Drawing Sheets

IMAGE HEATING APPARATUS

This application claims the right of priority under 35 U.S.C. §119 based on Japanese Patent Application No. 2002-135984 which is hereby incorporated by reference herein in its entirety as if fully set forth herein.

BACKGROUND OF THE INVENTION

1. Field of the Invention

The present invention relates to rising control for an image heating apparatus.

2. Description of the Related Art

An image forming apparatus using an electrophotographic process includes a fixing device. The fixing device fuses and fixes toner to a recording material by applying heat and pressure while nipping and transporting the recording material, on which the toner containing a resin, a magnetic substance, a coloring matter, etc. is electrostatically borne, in a press-contacting portion (nip portion) between heating means (a roller, an endless belt member, etc.) and pressurizing means (a roller, an endless belt member, etc.) which are maintained in mutual pressure-contact and in rotation.

FIG. 1 is a schematic view showing a structure of the image forming apparatus.

The image forming apparatus includes a photosensitive drum 1 that rotates in a direction shown by an arrow V1. After a photoconductive layer on a surface of the photosensitive drum 1 is uniformly charged by a primary charger 2, a light image exposure 3 of an original (not shown) causes an electrostatic latent image thereof to be formed on the surface of the photosensitive drum 1. According to the rotation of the photosensitive drum 1, the electrostatic latent image reaches a location corresponding to a developing device 4 and is developed by toner supplied from the developing device 4, thereby being visualized as a toner image.

Then, according to the rotation of the photosensitive drum 1, the obtained toner image advances to a transferring part arranged with a transferring charger 6.

Meanwhile, a recording material P that travels in synchronization with the photosensitive drum 1 is guided along a transport path 5 to reach the transferring part. In the transferring part, the recording material P adheres to the surface of the photosensitive drum 1.

In the transferring part, charges having a polarity reverse to that of the toner are imparted to the recording material P by the transferring charger 6, and then, the toner image on the surface of the photosensitive drum 1 is transferred onto the recording material P due to an electrostatic force.

On a downstream side of the transferring charger 6 along the travelling direction of the recording material, a separation charger 7 is arranged. From the recording material P onto which an unfixed toner image has been transferred, the charges are eliminated due to corona discharge by the separation charger 7. Thus, the recording material P has no longer an adsorbing force, and is then separated from the photosensitive drum 1 with the assistance of the elasticity inherent in the recording material P per se and also the self weight of the recording material P.

The separated recording material P is transported by a transport part 8 composed of a conveyor belt to the fixing device composed of a pair of a fixing roller 10 and a pressure roller 120 as the subsequent rotary member pair. While passing through the nip between the fixing roller 10 and the pressure roller 120, the unfixed toner image is fixed to the recording material P.

In that case, a rotating speed of the peripheral surface of the fixing roller 10 which is transporting the recording material P and a rotating speed of the peripheral surface of the photosensitive drum 1 are generally set to be different from each other. In general, the fixing roller 10 is set to be rotated slightly slower than the photosensitive drum 1. This is because the above setting can suppress a shock that is caused when a leading end of the recording material P enters the nip between the fixing roller 10 and the pressure roller 120, to thereby prevent deviation from occurring in the toner image transferred onto a trailing end of the recording material P still passing through the transferring part.

The fixing device will be described in further detail by reference to FIG. 2.

The fixing roller 10 includes an aluminum core 103 coated with a PFA tube 101 as a release layer.

Inside the aluminum core 103, a main heater 109 and a sub heater 108 are arranged.

The main heater 109 and the sub heater 108 are turned ON/OFF to thereby heat the fixing roller 10. In other words, the fixing device is structured so as to maintain only the fixing roller 10 at a high temperature. Note that the fixing device may be structured so as to maintain not only fixing roller 10 but also the pressure roller 120 at a high temperature by providing a heater inside the pressure roller 120 as well. Alternatively, the fixing device may be structured so as to maintain only the pressure roller 120 at a high temperature.

Outside the PFA tube 101 of the fixing roller 10, a thermistor 102 is arranged. Thus, an amount of energization to the main heater 109 and the sub heater 108 is controlled by a control circuit so as to maintain a constant temperature.

In a standby state, the temperature of the fixing roller 10 is controlled to a temperature that allows fixing.

In order to form the nip in which the recording material is nipped and transported, the pressure roller 120 is pressurized against the fixing roller 10.

The pressure roller 120 includes an iron core 106, silicone rubber 105 arranged on the iron core 106, and a PFA tube 104 as a release layer arranged as a surface layer.

The fixing device described above has a low power mode in order to reduce power consumption. In the low power mode, the temperature of the fixing roller 10 is controlled to a temperature lower than a standby temperature maintained in the standby state that allows image forming in which an image forming start signal is ready to be received. In order to recover the standby state from the low power mode, the temperature of the fixing roller 10 is raised to the standby temperature to effect an image formable state in which image forming is ready.

It is desired to provide an image forming apparatus in which energy consumption can be reduced in total by increasing the frequency of entering the above-mentioned low power mode while the usability is improved by minimizing a time for recovery of the image formable state from the low power mode. Thus, it is preferable to recover the image formable state from the low power mode within a given time.

Therefore, for the purpose of recovery within a given time, the structure is proposed in JP 2000-200013 A, which functions to measure the time needed to reach the standby temperature during the rising time from the power ON until the standby state, and according to the time thus measured, change the control temperature in the low power mode.

However, the environment at the above-mentioned rising time and the environment at the time of recovery form the low power mode are different in many cases. For example, the temperature of the fixing roller at the time of power ON may be lower than a controlled temperature thereof at the time of the low power mode. Accordingly, with the structure disclosed in JP 2000-200013 A, the recovery is impossible in a given time due to variation of environments.

On the other hand, in the low power mode, a relatively high temperature is set in many cases. Therefore, compared with the case of rising from the room temperature, it can be taken into consideration that heat radiation from the fixing roller is reduced in amount because the entire fixing device has been heated to a sufficient level, and the heater is continuously in an ON state during the recovery. Thus, even before reaching the standby temperature, the fixing roller is already in a state that allows fixing in many cases. Accordingly, in the case of rising from the low power mode, there is no need to effect the image formable state under the same conditions as those of the case of rising from the room temperature. As described above, there is no need to wait until the standby temperature is reached while the state that allows fixing is effected as in the conventional art, so that the time until the image formable state is recovered from the low power mode can be reduced.

SUMMARY OF THE INVENTION

In view of the above, an object of the present invention is to recover an image formable state from a low power mode in a short time.

Another object of the present invention is to recover an image formable state from a low power mode in a given time.

Still another object of the present invention is to provide an image heating apparatus including:

- a heating member for heating an image on a recording material;
- temperature control means for controlling a temperature of the heating member to a predetermined set temperature;
- waiting state setting means for setting a waiting state in which the temperature of the heating member is controlled to a first set temperature; and
- waiting state releasing means for releasing the waiting state in a shorter time between a set time from start of a waiting state releasing operation and a time needed to reach a second set temperature at which the waiting state is released.

DETAILED DESCRIPTION OF THE PREFERRED EMBODIMENT

Hereinafter, a preferred embodiment of the present invention will be described in detail by way of examples by reference to the drawings. Note that it is not intended to limit the scope of the present invention to sizes, materials, shapes, relative arrangements, etc. of the structural components described in this embodiment except that a specific description thereof is particularly described herein.

Figure 2:
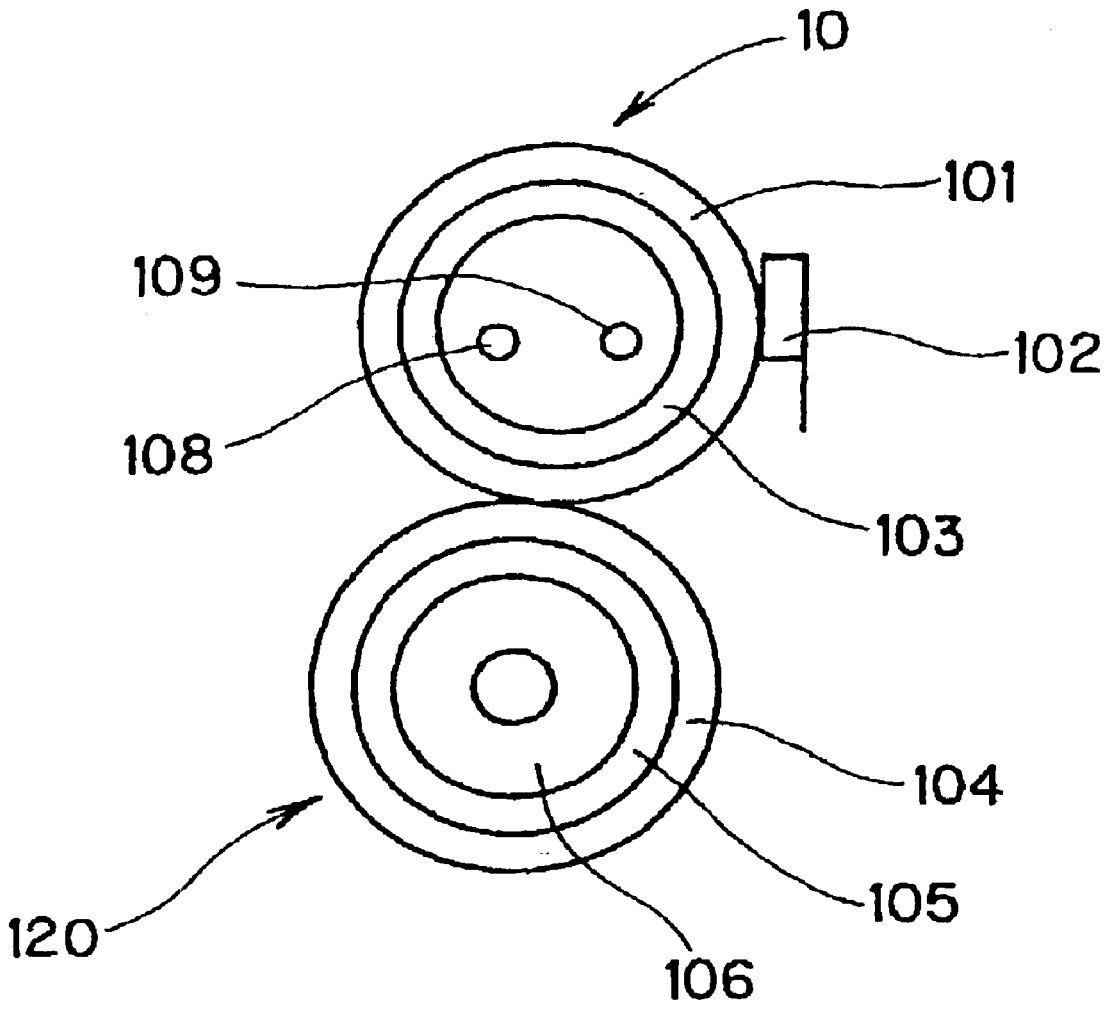
FIG. 2 is a schematic view showing a structure of a fixing device.
Figure 3:
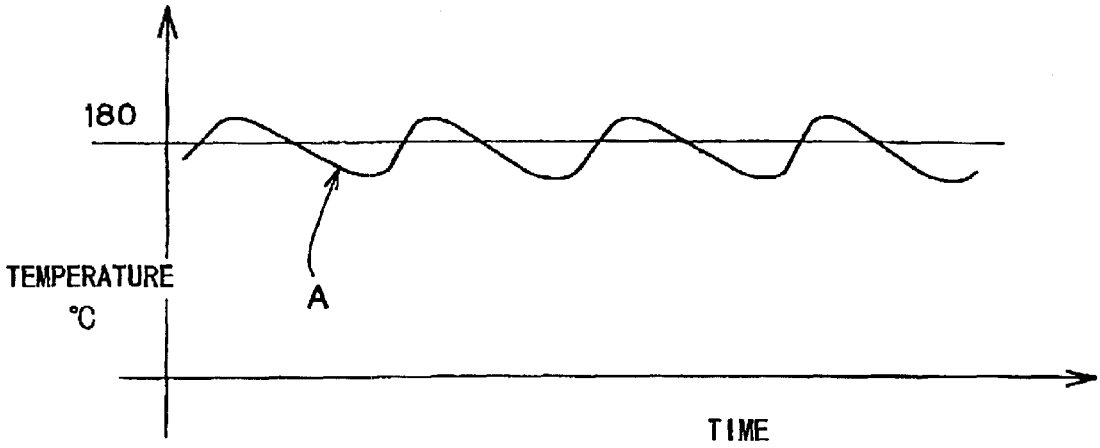
FIG. 3 is a chart showing fluctuation in temperature of a fixing roller.

An embodiment of the invention will be described by reference to FIGS. 1 to 3.

Figure 1:
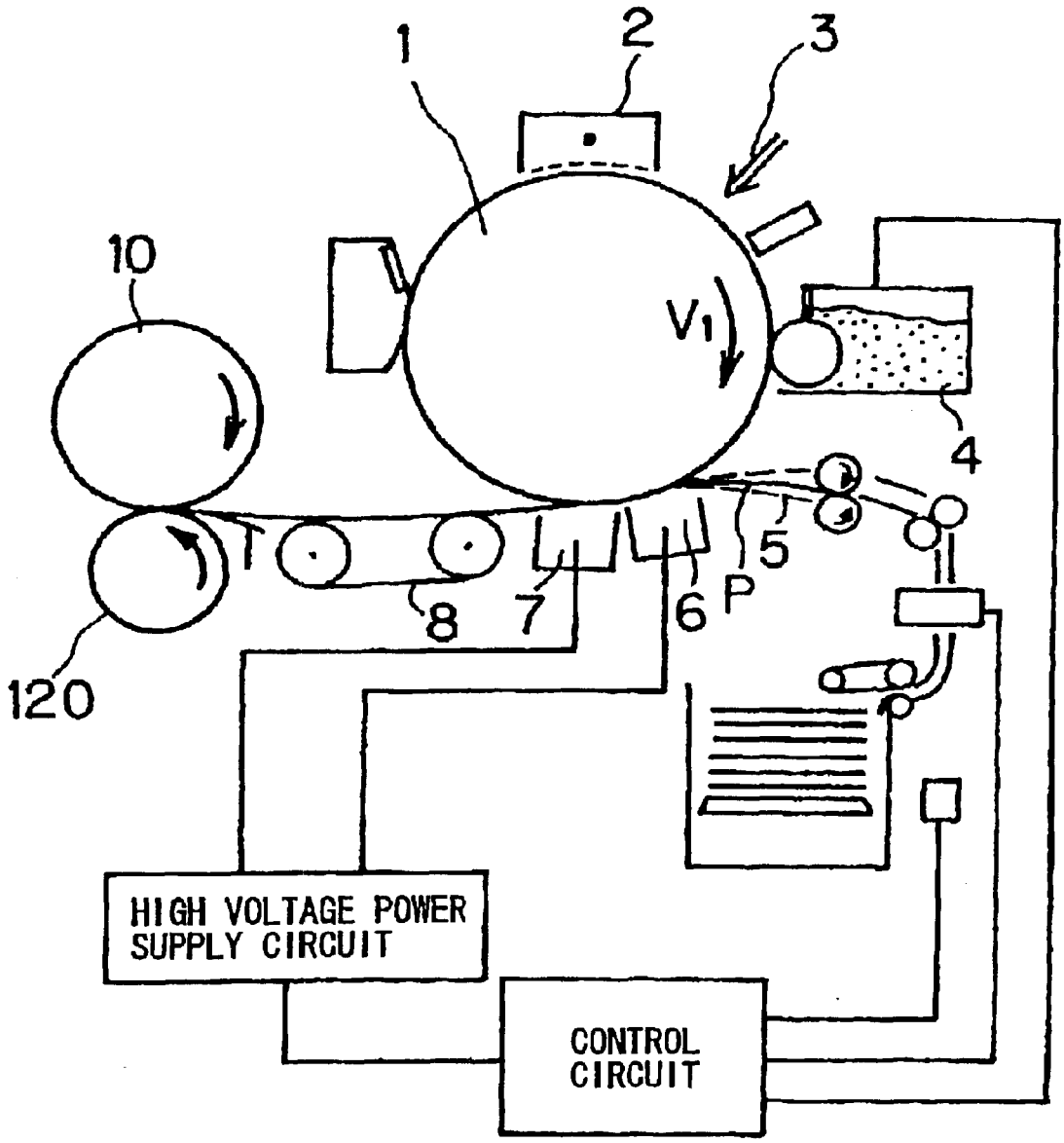
FIG. 1 is a schematic view showing a structure of an image forming apparatus.

FIG. 1 is a schematic view showing a structure of the image forming apparatus.

The image forming apparatus includes a photosensitive drum 1 as image bearing member that rotates in a direction shown by an arrow V1. After a photoconductive layer on a surface of the photosensitive drum 1 is uniformly charged by a primary charger 2 as charging means, a light image exposure 3 of an original (not shown) causes an electrostatic latent image thereof to be formed on the surface of the photosensitive drum 1. According to the rotation of the photosensitive drum 1, the electrostatic latent image reaches a location corresponding to a developing device 4 as developing means and is developed by toner supplied from the developing device 4, thereby being visualized as a toner image on the photosensitive drum 1.

Then, according to the rotation of the photosensitive drum 1, the obtained toner image advances to a transferring part arranged with a transferring charger 6 as a transferring member.

Meanwhile, a recording material P that travels in synchronization with the photosensitive drum 1 is guided along a transport path 5 to reach the transferring part. In the transferring part, the recording material P adheres to the surface of the photosensitive drum 1.

In the transferring part, charges having a polarity reverse to that of the toner are imparted to the recording material P by the transferring charger 6, and then, the toner image on the surface of the photosensitive drum 1 is transited and adsorbed onto the recording material P due to an electrostatic force. Thus, the toner image is transferred onto the recording material P, thereby forming an unfixed toner image on the recording material P.

On a downstream side of the transferring charger 6 along the travelling direction of the recording material, a separation charger 7 as separation charging means is arranged. From the recording material P onto which the unfixed toner image has been transferred, the charges are eliminated due to corona discharge by the separation charger 7. Thus, the recording material P has no longer an adsorbing force, and is then separated from the photosensitive drum 1 with the assistance of the elasticity inherent in the recording material P per se and also the self weight of the recording material P.

The separated recording material P is transported by a transport part 8 composed of a conveyor belt to the fixing device composed of a rotary member pair of a pressure roller 120 as a pressurizing member and a fixing roller 10 as a fixing member that serves as a heating member and fixes the unfixed toner image on the recording material using heat. By being passed through the nip in which the pressure roller 120 is brought into press-contact with the fixing roller 10 and the recording material P is nipped and transported, the unfixed toner image on the recording material P is fixed onto the recording material P using heat and pressure.

In that case, when the recording material P passes through the nip formed between the fixing roller 10 and the pressure roller 120, a rotating speed of the peripheral surface of the fixing roller 10 which is transporting the recording material P and a rotating speed of the peripheral surface of the photosensitive drum 1 are generally set to be different from each other. In general, the fixing roller 10 is set to be rotated slower than the photosensitive drum 1. This is because the above setting can suppress a shock that is caused when a leading end of the recording material P enters the nip between the fixing roller 10 and the pressure roller 120, to thereby prevent deviation from occurring in the toner image transferred onto a trailing end portion of the recording material P still passing through the transferring part.

The fixing device will be described in further detail by reference to FIG. 2.

The fixing roller 10 as a fixing member that serves as a heating member and fixes the unfixed toner image on the recording material using heat includes an aluminum core 103 as a core metal which is coated with a PFA tube 101 that is formed of fluororesin and serves as a release layer provided as a surface layer.

Arranged inside the aluminum core 103 are a main heater 109 and a sub heater 108 which serve as heaters and are composed of halogen heaters. The main heater 109 exhibits a heat generation distribution having a high central portion in the longitudinal direction. The sub heater 108 exhibits a heat generation distribution having two high ends in the longitudinal direction.

The main heater 109 and the sub heater 108 are repeatedly turned ON and OFF to thereby heat the fixing roller 10. Then, based on an output from a thermistor 102 described later, the fixing roller 10 is maintained at a set temperature.

In other words, the fixing device according to this embodiment is structured such that the fixing roller 10 is controlled to the set temperature by the sub heater 108 and the main heater 109.

Note that the fixing device may be structured so as to maintain not only fixing roller 10 but also the pressure roller 120 as a pressurizing member at a high temperature by providing a heater inside the pressure roller 120 as well. Alternatively, the fixing device may be structured so as to maintain only the pressure roller 120 at a high temperature.

In this embodiment, the halogen heater is used as the heater. Instead, a structure using an induction coil and adopting an induction heating system may be used. In the induction heating system, a magnetic field generated from the induction coil by flowing a current in the induction coil causes an eddy current to develop in a metal formed of iron etc. as a conductive layer of the fixing member, so that the fixing member per se generates heat. Of course, a structure using another heating method may be adopted.

Outside the PFA tube 101, the thermistor 102 as a temperature detecting member is arranged. Thus, by a control circuit as control means for controlling the temperature of the fixing roller 10, the temperature is controlled to a constant temperature. That is, based on the output from the thermistor 102, an amount of energization to the heater is controlled by comparing the output with a target value.

The pressure roller 120 is arranged as a pressurizing member that forms the nip by being opposed to and pressurized against the fixing roller 10.

The pressure roller 120 includes an iron core 106 as a core metal, silicone rubber 105 as an elastic layer which is arranged on the iron core 106, and a PFA tube 104 that is formed of fluororesin and serves as a release layer provided as a surface layer.

In a standby state as a standby mode that allows image forming, the temperature of the fixing roller 10 is controlled to a temperature that allows fixing.

Here, in this embodiment, the standby temperature is set to 180° C., and the set temperature in the low power mode as a waiting state is set to 150° C. The set temperature serves as a first set temperature that is to be controlled. Naturally, the set temperature in the low power mode is set to be lower than the standby temperature. Also, the standby temperature of 180° C. coincides with the target temperature serving as a second set temperature.

A concept concerning temperature control in the standby state will be explained by reference to FIG. 3. FIG. 3 shows fluctuation in temperature of a fixing roller 10 in the standby state with time.

At the point A immediately before the main heater 109 and the sub heater 108 are turned ON, the conditions of fixing property are the strictest in the standby state. This is because the main heater 109 and the sub heater 108 are in an OFF state, and therefore, an amount of heat remaining in the aluminum core 103 is small. In view of the above, the temperature in the standby state is set so as to satisfy the fixing property even at the point A. Note that the ripple observed in FIG. 3 is approximately ±5° C. with respect to 180° C.

However, during the recovery of the image formable state from the low power mode, the main heater 109 and the sub heater 108 continue to be in an ON state. Accordingly, the heat is being made to flow through the aluminum core 103 toward the surface of the fixing roller 10 at all times, thereby making it possible to provide the heat to the recording material even if the surface temperature of the fixing roller 10 is low and to satisfy the fixing property. As a result, the heat is being made to flow from the heater 108 and the heater 109 to the aluminum core 103, thereby making it possible to satisfy the fixing property even if the temperature is lower than the above-mentioned point A.

Note that in the structure of this embodiment, it takes 45 seconds for the temperature of the fixing roller 10 to rise from 150° C. in the low power mode to the target temperature of 180° C. at which the waiting state is released to effect the image formable state. However, the time varies in many cases depending on the surrounding environment such as a low temperature environment, so that it does not always take the above-mentioned time to reach the target temperature.

On the other hand, in the case where the waiting state is released from the low power mode and the image formable state is recovered, it is known that the temperature satisfying the fixing property becomes lower than the temperature needed to rise from the room temperature to the image formable state. The reason is as follows.

In the case of supplying heat to the fixing member from the room temperature, even if the temperature of the fixing member rises to the temperature that allows fixing, the entire fixing device is not yet heated to a sufficient level. Thus, if a continuous fixing operation for fixing the unfixed toner image to plural sheets of the recording materials is performed in the above state, the fixing member is deprived of the heat by the recording material and concurrently by the periphery of the fixing device. In particular, due to the large difference between the temperature of the fixing member and the peripheral temperature thereof, the amount of heat of which the fixing member is deprived becomes large. Even though the fixing property is satisfied at the time of start of fixing operation, as time elapses, the amount of heat of which the fixing member is deprived becomes larger than the amount of heat supplied to the fixing member, thereby failing to satisfy the fixing property.

On the other hand, in the case of rising to the image formable state after the waiting state is released from the low power mode, as a result of waiting in the low power mode, the amount of heat of which the fixing roller 10 at the temperature for the image formable state is deprived by the recording material is almost the same as in the case of rising from the room temperature, while the amount of heat of which the fixing roller 10 is deprived by the periphery of the fixing roller 10 is smaller than in the case of rising from the room temperature. This is because the entire fixing device has already been heated and the difference in temperature between the fixing roller 10 and the periphery thereof is therefore small. Accordingly, when performing a continuous fixing operation, the fixing property is satisfied at the start of fixing operation, and even after the time elapses, the amount of heat of which the fixing roller 10 is deprived is smaller than in the case of rising from the room temperature, thereby enabling the continuous fixing operation.

Thus, in this embodiment, even when the predetermined set time of 30 seconds is taken to release the waiting state and shift to the image formable state, the temperature of the fixing roller 10 has reached a range for satisfying the fixing property. After 30 seconds is taken to recover the usable state to effect the image formable state, the main heater 109 and the sub heater 108 are continuously turned ON until the fixing roller 10 recovers the temperature of 180° C. Accordingly, it is possible to satisfactorily perform the continuous fixing operation for a long period of time. Here, the term "image formable state" represents the standby state in which an image can be formed by the input of image forming signals. In other words, even if the fixing operation is started in the image formable state, the fixing property can be satisfied.

In view of the above, in this embodiment, the temperature of the fixing roller 10 for satisfying the above-mentioned fixing property ranges from 165° C. to 175° C., which is lower than the lowest point of the ripple in controlled standby temperature as the image formable state.

Note that the temperature for satisfying the fixing property is not always determined based on the relationship as described above, but varies depending on, for example, the heat capacity or the coating thickness of the fixing roller or the pressure roller, the amount of heat generated by the heater, or the like.

Also, with regard to the fixing property exhibited herein, the density of an image is compared before and after the image having undergone fixing is scratched to and fro five times by a spindle weighing 200 g and covered with silbon paper, and the image showing a density reduction ratio of 10% or less is assumed to be in the state for satisfying the fixing property.

Further, if the set temperature in the low power mode is low, when the waiting state is released from the low power mode and the image formable state is recovered, there is a case where the temperature of the fixing roller 10 does not reach the range for satisfying the fixing property if a predetermined set time, for example, 30 seconds, has elapsed after the low power mode. Therefore, the set temperature in the low power mode is desirably 100° C. or higher.

On the other hand, in order for the temperature of the fixing roller 10 to recover the target temperature of 180° C., there is a case where the recovery takes less than the predetermined set time of 30 seconds for releasing the waiting state from the low power mode. This is because the temperature of the fixing roller 10 is still high, for example, in the case where only a short time has elapsed since the normal standby state was shifted to the low power mode, or like case.

More specifically, if during the shift from the image formable state at the standby temperature of 180° C. to the low power mode, the image formable state is to be recovered again and the temperature of the fixing roller is, for example, 170° C., there is a case where the target temperature of 180° C. is reached before the set time of 30 seconds is elapsed. Therefore, in that case, the release of the waiting state and the recovery of the image formable state are performed in a shorter time either until the target temperature of 180° C. is reached or until the set time of 30 seconds is elapsed before reaching 180° C. Accordingly, the above structure allows the shift to the image formable state before the set time is elapsed.

Consequently, without being affected by the surrounding environment of the fixing device, the waiting state is released from the low power mode and the rising to the image formable state can be performed within the set time.

Hereinabove, the embodiment of the present invention has been described. However, the present invention is not limited to the above embodiment at all, and various other modifications can be made within the scope of technical principles of the present invention.

What is claimed is:

1. An image forming apparatus comprising:

image forming means for forming an image on a recording material;

fixing means for thermal-fixing the image on the recording material;

detecting means for detecting a temperature of the fixing means;

control means for controlling supplied power to the fixing means according to the detected temperature of the fixing means;

shifting means for shifting to a low-powered mode for waiting in a reduced power state, wherein the supplied power to the fixing means is reduced, an image forming operation being inhibited in the low-powered mode; and recovering means for recovering from the low-powered mode by increasing the supplied power to the fixing means to starting an image forming operation, wherein the recovering means releases the low-powered mode at a predetermined time elapsed from a starting time of a recovering operation irrespective of the detected temperature of the fixing means.

2. An image forming apparatus according to claim 1, wherein the recovering means maintains a state of increasing the supplied power to the fixing means from the starting time of the recovering operation to a starting time of a fixing process.

3. An image forming apparatus according to claim 2, wherein a target temperature of the fixing means during the low-powered mode is set to a temperature recoverable to a predetermined fixing temperature from the starting time of the recovering operation to the starting time of the fixing process.

4. An image forming apparatus according to claim 3, wherein the recoverable temperature is 100° C. or more.

5. An image forming apparatus according to claim 2, wherein the fixing means includes a first heater and a second heater, and the recovering means continues to supply power to the first and second heaters from the starting time of the recovering operation to the starting time of the fixing process.

6. An image forming apparatus, comprising:

image forming means for forming an image on a recording material;

fixing means for thermal-fixing the image on the recording material;

detecting means for detecting a temperature of the fixing means;

control means for controlling the temperature of the fixing means according to a detected temperature of the fixing means;

shifting means for shifting to a low-powered mode for waiting in a reduced power state, wherein the supplied power to the fixing means is reduced, an image forming operation being inhibited in the low-powered mode; and recovering means for recovering from the low-powered mode by increasing the supplied power to the fixing means to start an image forming operation, wherein the recovering means releases the low-powered mode at the earliest of either the predetermined time elapsed from a starting time of a recovering operation or a time that a temperature of the fixing means reaches a predetermined temperature.

7. An image forming apparatus according to claim 6, wherein the recovering means maintains a state of increasing the supplied power to the fixing means until starting a fixing process, when the predetermined time elapsed from the starting time of the recovering operation is earlier than the time that the temperature of the fixing means reaches the predetermined temperature.

8. An image forming apparatus according to claim 7, a target temperature of the fixing means during the low-powered mode is set to a temperature recoverable to a predetermined fixing temperature from the starting time of the recovering operation to a starting time of the fixing process.

9. An image forming apparatus according to claim 8, wherein a recoverable temperature is 100° of more.

10. An image forming apparatus according to claim 7, wherein the fixing means includes a first heater and a second heater, and the recovering means continues to supply the power to the first and second heaters from the starting time of the recovering operation to the starting time of the fixing process.

* * * * *